United States Patent [19]

Scribner

[11] 4,195,761

[45] Apr. 1, 1980

[54] PNEUMATIC FEEDER FOR PUNCH PRESSES AND THE LIKE

[76] Inventor: Albert W. Scribner, 6 Country Club Rd., Darien, Conn. 06820

[21] Appl. No.: 910,840

[22] Filed: May 30, 1978

[51] Int. Cl.[2] ..... B65H 17/42; B65H 17/36; F16K 39/00

[52] U.S. Cl. ..... 226/115; 226/146; 226/151; 226/159; 226/162; 251/230

[58] Field of Search ..... 226/108, 112, 115, 146, 226/151, 150, 159, 162, 167, 144, 165; 251/230; 271/85, 108, 268

[56] References Cited

U.S. PATENT DOCUMENTS

| | | | |
|---|---|---|---|
| 3,136,335 | 6/1964 | Beech | 251/230 X |
| 3,329,327 | 7/1967 | Scribner | 226/150 |
| 3,485,430 | 12/1969 | Scribner | 226/150 X |
| 3,512,438 | 5/1970 | Burdge | 226/115 X |
| 3,753,522 | 8/1973 | Voges | 226/162 X |
| 3,847,320 | 11/1974 | Scribner | 226/115 |
| 4,051,987 | 10/1977 | Scribner | 226/159 |

*Primary Examiner*—Edward J. McCarthy

[57] ABSTRACT

A dual slide pneumatic feeder for intermittently advancing stock into the work station of a punch press or the like wherein the fluid motors of the feeder are controlled by a fluid valve means that is adapted to be intermittently driven by a ratchet mechanism. The ratchet mechanism is adapted to be actuated from two different control points; first from a trigger means that is operable in response to the movement of the press ram, and secondly from a means operable in response to the completion of a feed stroke of one or both of the two feed slides. In this control environment the two feed slides may be made to execute a plurality of consecutive feed strokes in response to each cycle of operation of said press.

27 Claims, 28 Drawing Figures

Fig. 6
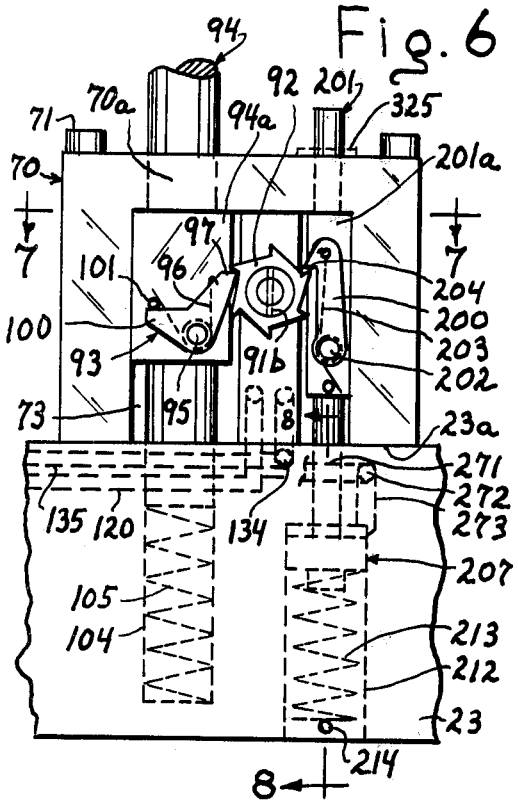
Fig. 7
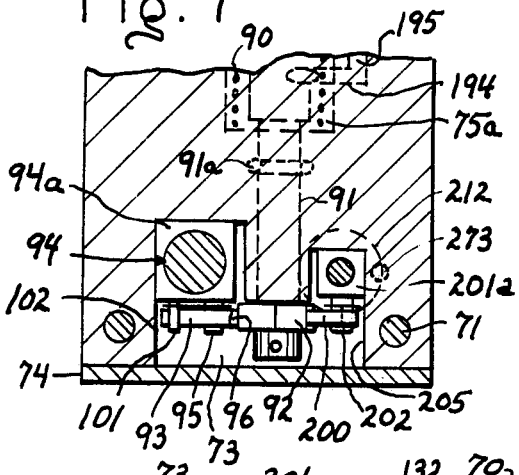
Fig. 8
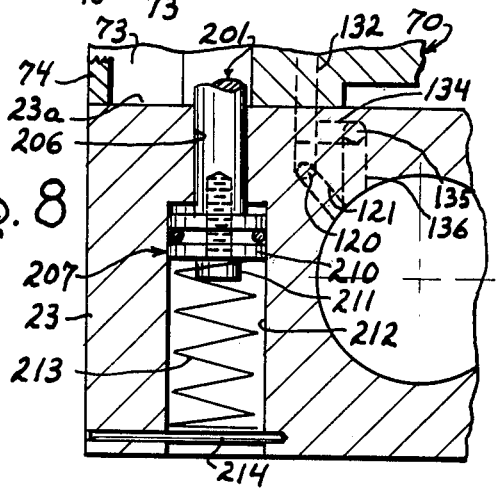
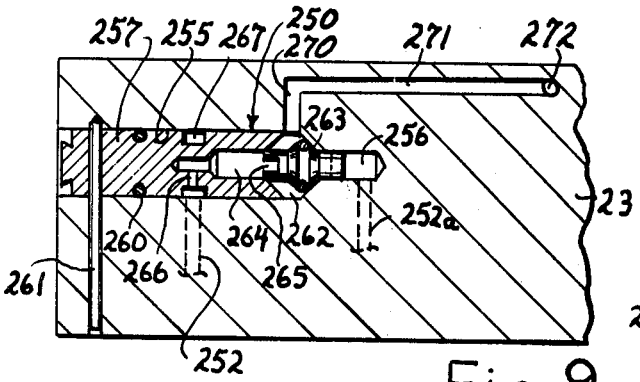
Fig 9
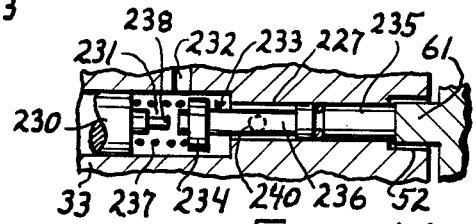
Fig. 10
Fig. 21
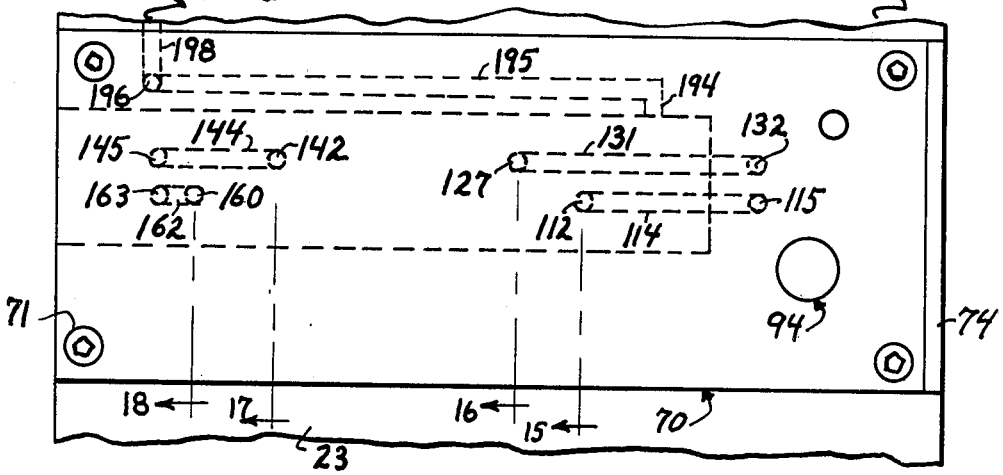

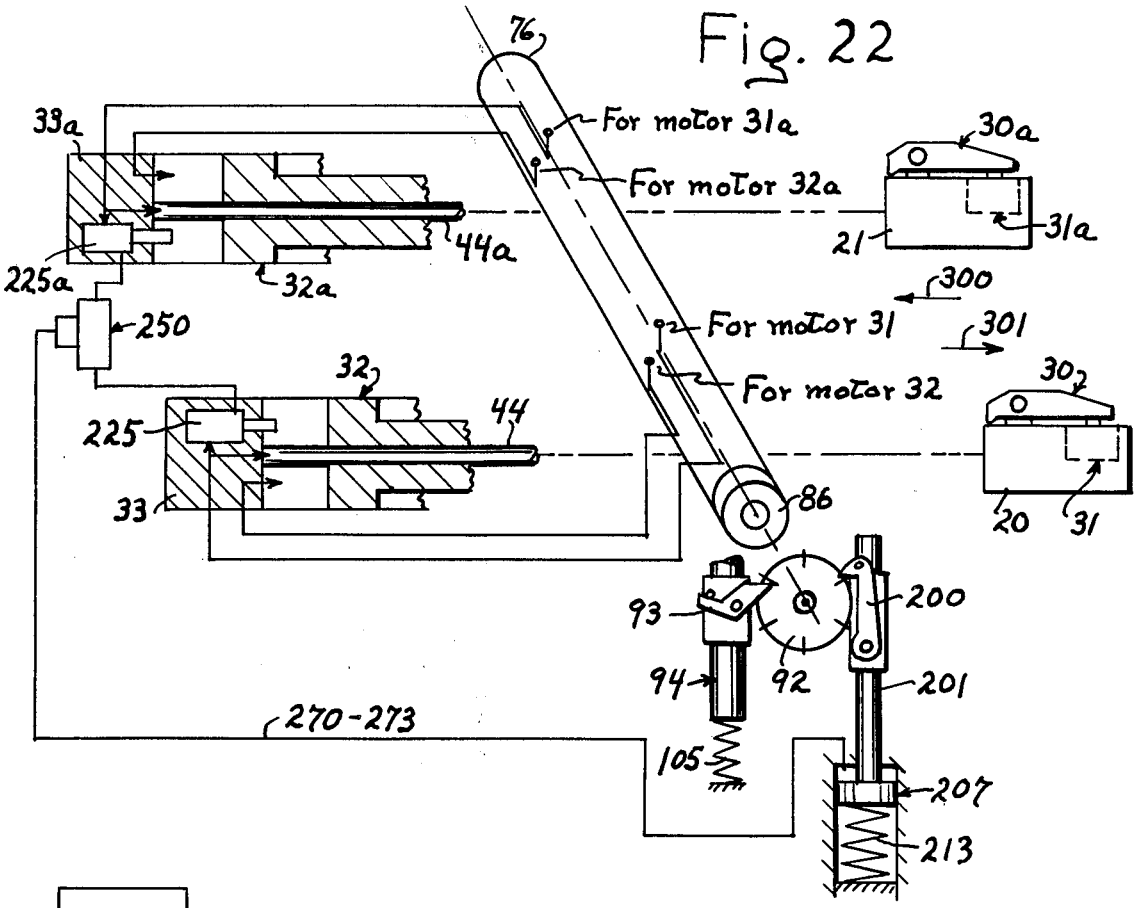
Fig. 22
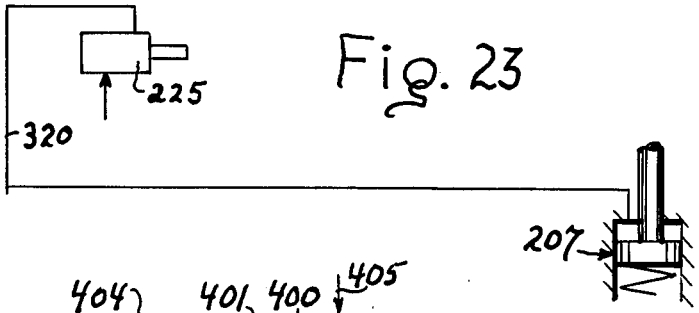
Fig. 23
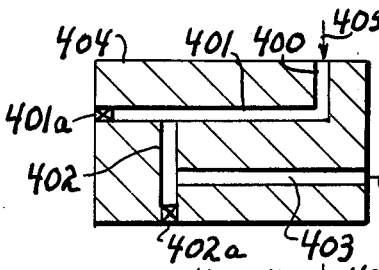
Fig. 24
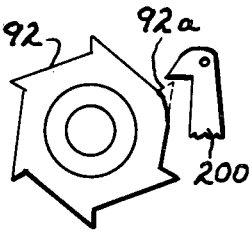
Fig. 26
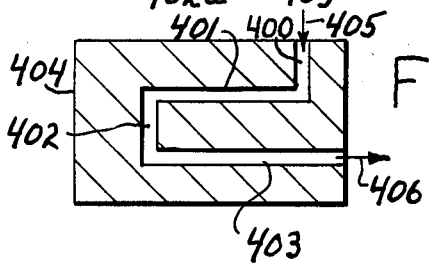
Fig. 25
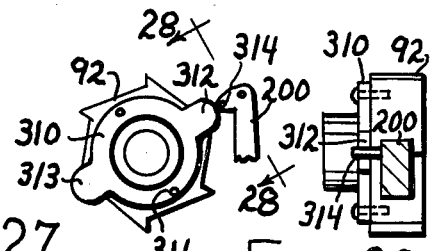
Fig. 27
Fig. 28

PNEUMATIC FEEDER FOR PUNCH PRESSES AND THE LIKE

BACKGROUND OF THE INVENTION

In prior dual slide pneumatic feeders of the type shown in my prior U.S. Pat. No. 4,051,987 the ratchet drive means for the feeder control valves is actuated from one control point, namely a feed cycle trip plunger that is adapted to be operated in response to the movement of the working ram of the punch press. This type of control is particularly advantageous for high speed feeding operations where only one feed stroke is desired for each cycle of operation of the press. It has been determined however that dual slide feeders may also be advantageously used in normal speed stock feeding operations where two or more feed strokes are to be generated for each operative cycle of the press; it being possible here for example to generate three substantially equal feed strokes in about the same time as that required for a given single feed stroke that is three times as long as one of the said three short strokes. When using a dual slide feeder to carry out this multiple feed stroke per press cycle control technique (a) the physical size, particularly the length, of the feeder may be very significantly reduced for any given maximum feed length capacity desired for a feeder, and (b) the cyclic speed of the press need not be decreased from that otherwise used in connection with a corresponding single slide feeder. Because dual slide feeders are inherently faster than single slide feeders the multiple stroke dual slide feeder can still be controlled by a continuously running press with the result that an easy quick set up procedure may be retained and no special cumbersome or expensive attachments are required. Multiple stroke repeater control attachments are known for reciprocating slide type feeders but these may be nearly as expensive as the feeder itself and may require as much or more set up time than that otherwise required for the feeder itself. Further, conventional repeater systems are in most cases so slow that the press-feeder control arrangement has to be reversed, i.e., so that the feeder triggers the operation of the press, rather than the more efficient arrangement wherein each successive cycle of a continuously running press triggers the operation of the feeder.

SUMMARY OF THE INVENTION

The present invention provides a relatively simple direct and inexpensive valve control system for a dual slide pneumatic feeder whereby (a) multiple stock feed strokes of the two feed slides may be generated in response to each cycle of operation of the press associated therewith and (b) the same quick and easy set up procedure corresponding to that used with conventional single slide air feeds of the type illustrated in U.S. Pat. Nos. 3,038,645 and 3,329,327 may still be used. The present valve control system includes an incrementally rotatable ratchet wheel for driving the feeder control valve means; the ratchet wheel being adapted to be actuated from two different control sources, one source being under the control of the press and the other source being under the control of one or both of the feed slides of the feeder.

The present control system includes a feed triggering plunger which is operated in response to the operation of the press and which in operation is adapted to advance the ratchet wheel one step so that the first one of said feed slides partakes of a feed stroke. An additional ratchet wheel advancing means is provided which is operative in response to the completion of the said feed stroke for advancing the rachet wheel a second step so that the other or second feed slide may partake of a feed stroke. By using this type of control system for the feeder one feed stroke may be executed by each of the two feed slides in response to each cycle of operation of the press. In another version of the present control system the completion of the feed stroke of said second feed slide serves to advance said ratchet wheel a third step so that said first feed slide may execute another feed stroke which in turn may serve to advance said ratchet wheel a fourth step so as to cause said second feed slide to execute another feed stroke, and so forth through as many alternate feed strokes as may be desired for said two feed slides for each cycle of operation of said press.

The present combination of an improved multiple feed stroke control system and a dual slide feeder enables the present feeder to be relatively small, physically, and thus reduced in cost, and very flexible as regards its use and feed length capabilities.

The principle object of the present invention is to provide an improved multiple feed stroke control for a pneumatic feeder.

Another object of the invention is to provide a simple low cost reliable rotary drive system, such as a ratchet mechanism, for the valve means of a pneumatic feeder wherein said rotary drive system may be operated by each of two or more different control means in the feeder.

Another object of the invention is to provide a very simple inexpensive press interface arrangement for a dual slide feeder having a multiple feed stroke control system.

A further object of the invention is to provide a novel multiple feed stroke control system for a dual slide pneumatic feeder which system is adapted to be triggered in response to each cycle of operation of a continuously running punch press or the like.

Other objects of the invention will become apparent as the disclosure progresses.

BRIEF DESCRIPTION OF THE DRAWINGS

FIG. 6 is a front elevational view with the cover plate 74 removed and illustrates a ratchet mechanism that is adapted to drive the fluid valve means.

FIG. 7 is a sectional view taken along section line 7—7 of FIG. 6.

FIG. 8 is a partial sectional view taken along section line 8 of FIG. 6.

FIG. 9 is a partial sectional view taken along sectional line 9—9 of FIG. 2.

FIG. 10 is a partial sectional view corresponding to FIG. 3 and shows the active position of some of the parts of said FIG. 3.

FIG. 21 is a plan view of the valve block and the immediately adjacent parts of the main body portion of the feeder frame, and illustrates the arrangement of the pressure fluid conducting lines in said valve block.

FIG. 22 is a perspective view schematically illustrating the overall control arrangement for the present feeder.

FIG. 23 is a schematic view illustrating a modified version of the control arrangement illustrated in FIG. 22.

FIGS. 24 and 25 are cross sectional views illustrating the actual and the drawing construction respectively for the fluid conducting lines of the present feeder.

FIG. 26 is an elevational view illustrating the construction of one version of the present ratchet wheel.

FIG. 27 is an elevational view illustrating a selectively mountable cam arrangement for determining the number of feed strokes for each initiation of operation of the present feeder.

FIG. 28 is a view taken along section line 28—28 of FIG. 27.

DETAILED DESCRIPTION OF THE INVENTION

The present invention affords improvements over the dual slide feeder shown and described in my U.S. Pat. No. 4,051,987 and the disclosure in said Patent is incorporated herein by reference. The construction and operation of some portions of the present dual slide feeder may be similar to that disclosed in said Patent excepting where modified and added to as shown and described herein.

Figure 1:
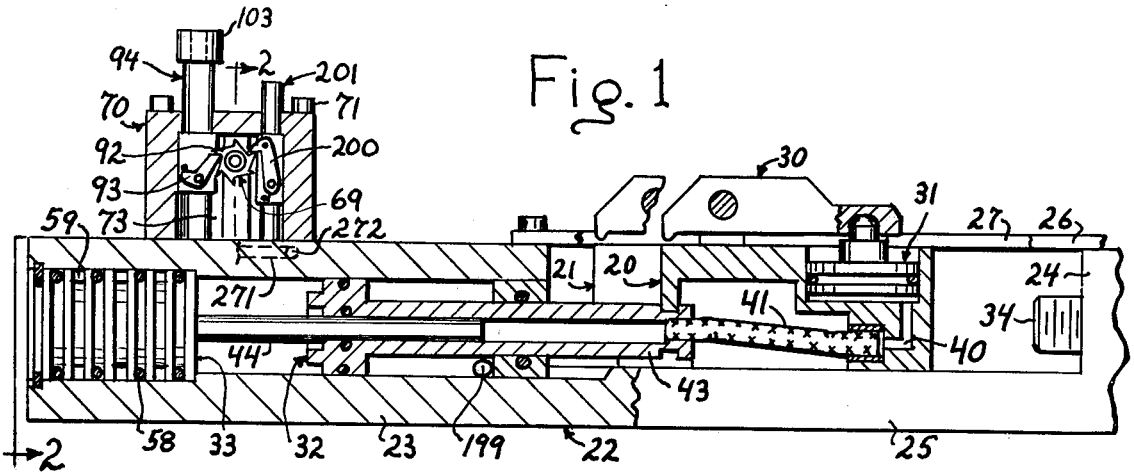
FIG. 1 is an elevational view in partial section taken along section line 1—1 of FIG. 2 and illustrates the general structural arrangement of the present feeder.

By way of a general review of the feeder illustrated in said Patent two similar feed slides 20 and 21, FIG. 1, are carried on the one-piece frame 22 that is defined by a main body portion 23, an end block portion 24 and an integral interconnecting plate portion 25; the slides 20, 21 being respectively restrained for reciprocating movement by means of two laterally adjustable rails 26 and 27 carried by said frame. Feed slide 21 and its associated apparatus is similar to that for slide 20 hence only the latter will be described herein. Slide 20 carries a pivot lever type stock gripping means 30 that is adapted to be spring biased to an open or stock releasing position and to be moved to a stock gripping position by means of an associated single-acting fluid motor 31. Feed slide 20 is adapted to be reciprocating through alternate feed and nonfeed strokes by means of a double-acting main fluid motor 32; the forward or left end, as seen in FIG. 1, of the main cylinder of said motor 32 being closed by means of a cylindrical plug 33.

The effective length of the feed stroke of each feed slide may be adjusted by means of a threaded member such as 34, FIG. 1, carried by said end block portion 24 of the feeder frame 22. In operation the feed slides 20 and 21 may be alternately actuated in substantially 180 degree phase relation so that said slides may alternately and incrementally feed the strip stock to be fed into the work station of a punch press or the like.

For ease in later describing the rotary valving system for the present feeder the fluid conduit line arrangements to said fluid motors will be described first. Pressure fluid is adapted to be supplied to and exhausted from the single acting fluid gripping motor 31 on feed slide 20 through a line 40, FIG. 1, formed in said slide; which line communicates with the outer end of a short length of flexible tubing 41 that is coupled by any suitable means to the lower rear portion of the slide 20. The other end of this length of flexible tubing is coupled by any suitable means to the outer end of the tubular piston rod 43 of the main fluid motor 32; the inner end of said piston rod telescopically engaging a stationary coaxial tube 44 that in turn is coaxially secured to said plug 33. As may be seen the flexible tubing 41 is disposed substantially internally in the lower recessed portion of the slide 20 and is thus not exposed to being caught on external objects and is not flexed during each cycle of movement of the slide 20, yet may be flexed to permit the lateral adjustment of the feed slide relative to the axis of the said piston rod 43.

The cylindrical plug 33 is formed with an axial conduit line 45, that communicates with the adjacent end of tube 44 and with a radially disposed line 46 which in turn communicates at its radially outer end with an annular groove 47 peripherally formed on the outer cylindrical surface of said plug. Plug 33 is secured in place in the head end of the main cylinder 48 of fluid motor 32 by any suitable means such as a suitable retaining ring 50, FIG. 3. Pressure fluid is supplied to and exhausted from the head end of said main cylinder 48 through a rightangled line 51, FIG. 3, which communicates at one end thereof with an annular groove 52 formed on the inner face of said plug and at the other end thereof with a second separate peripheral plug groove 53. Axially spaced O-ring seals such as 58 are provided on the outside of plug 33 so as to mutually isolate the annular grooves 47, 53, and a further similar groove 59 (to be described later) from one another. The terminal portion of a feed stroke of feed slide 20 is cushioned by the buffer type cooperation of an annular flange 61, FIG. 3, formed on the forward face of the main piston of motor 32 with the said correspondingly dimensioned annular groove 52 in the adjacent face of the plug 33.

Figure 2:
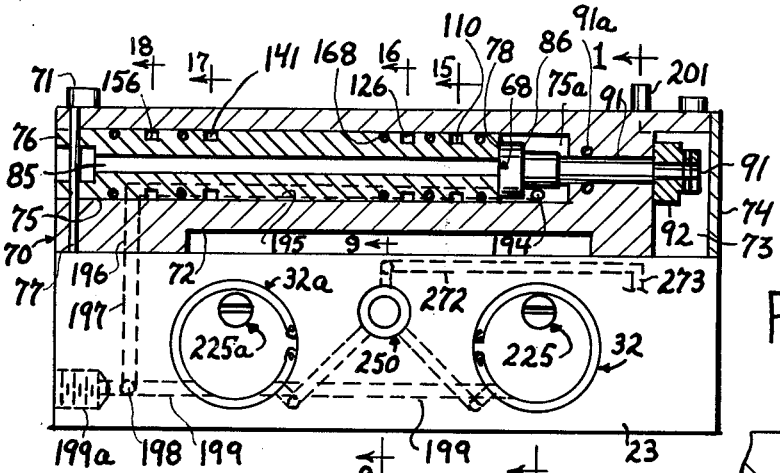
FIG. 2 is a partial sectional view taken along section line 2—2 of FIG. 1.

The rotary valving system, 68 FIG. 2, and the ratchet drive mechanism 69 therefor will now be described. The rotary valving system is adapted to control the flow of pressure fluid to and from the four fluid motors for the present feeder; i.e. to and from the two fluid motors, such as 31, for actuating the two stock gripping means, such as 30, and the two main fluid motors, such as 32, for actuating the feed slides 20 and 21. This valving system includes a rotary valving member that is adapted to be intermittently rotatably indexed to and stopped at successive predetermined operative positions by means of said ratchet drive mechanism 69, FIG. 1. Referring now primarily to FIGS. 1, 6 and 7 there is shown a main valve body or block 70 that is adapted to be secured on the upper surface of said main body portion 23 of the frame by means of suitable screws 71. The valve block is centrally recessed at its bottom as indicated at 72 of FIG. 2 so as to permit passage thereunder of the stock that is to be fed by the feeder, and is further vertically recessed at its right hand end, as seen in FIG. 2, so as to afford a box-like chamber 73 for the valve ratchet drive means 69 to be described. Chamber 73 is adapted to be closed at its right hand end, as seen in FIG. 2, by means of a plate member 74 that is secured to said valve block by any suitable means such as screws not shown. The valve block 70 is formed with a central longitudinal bore 75, FIG. 2, in which an elongated cylindrical valve plug 76 is fixedly secured by any suitable means such as a pin 77, FIG. 2. The inner end of plug 76 is provided with a smooth flat polished valving surface 78, FIGS. 11 and 12, having four valving ports 80, 81, 82 and 83 formed therein; the respective centers of said ports being located at the points indicated on a circular line of centers 84. An exhaust line 85 extends axially throughout the length of valve plug 76. Cooperating with the stationary plug end surface 78 is rotary valve cup member 86, FIGS. 2, 13 and 14, which has a smooth flat polished and recessed end face 87, FIGS. 13 and 14, that may be normally lightly biased into coaxial rotary sliding contact with said smooth plug end surface 78 by means of a spring 90, FIG. 7. The rotary valve cup member has a coaxial stem portion 91 that is rotatably mounted in a suitable bore formed through the right hand end, as seen in FIG. 2, of the valve block 70. The said valve block 70 is provided with a suitable O-ring seal 91*a* as shown in FIG. 2 so as to prevent leakage of pressure fluid past said stem portion 91 and into said chamber 73. The outer end of stem portion 91 has secured thereto by means of a pin 91*b*, FIG. 6, a six toothed ratchet wheel 92, FIG. 6, that is adapted to be rotatably indexed through successive 60 degree displacements by means of a first or trigger pawl 93; the latter being pivotally mounted on the vertically reciprocable plunger 94 by means of a suitable pivot stud 95, FIG. 6. The pawl 93 is biased in a clockwise direction, as seen in FIG. 6, by a suitable spring 96 so that the operative nose 97 of the pawl is continuously urged towards engagement with the teeth of the ratchet wheel. The tail 100 of the pawl is adapted to enage a pin 101 fixed to said plunger 94 thereby limiting the extent of possible clockwise movement, as seen in FIG. 6, for pawl 93. The axially central portion 94*a*, FIGS. 6 and 7, of the plunger which carries said pawl 93, spring 90, stud 95 and pin 101 has a rectangular cross sectional shape, as is best seen in FIG. 7, and is located so that one flat side thereof may vertically slide along the flat inner surface 102, FIG. 7, of the recessed end of the valve block 70. The remaining portions of the plunger 94 are cylindrical; the upper end thereof extending through a suitable aperture in the upper wall 70*a* of the valve block 70 and having a cap 103, FIG. 1, secured by any suitable means to the top thereof while the lower end thereof extends into a bore 104, FIG. 6, formed in said main body portion 23 of the feeder frame 22. A spring 105 disposed in said bore 104 serves to bias plunger 94 towards its normal upper FIG. 6 position as determined by engagement of the upper shoulders of said rectangularly cross sectioned portion 94*a* of the plunger with the lower surface of the said wall 70*a* of the valve block.

As will be apparent from FIGS. 1, 2, 6 and 7 when plunger 94 is moved vertically downwardly in response to the downward movement of the press ram the pawl 93 will idly move past the next ratchet tooth while the rotary valve member 86 remains stationary. The ensuring upward movement of said ram will permit the spring 105 to yieldably drive the plunger 94 upwardly; the terminal portion of this upward plunger movement serving to rotatably index or drive the ratchet wheel 92 and thus also the valve cup member 86 through a 60 degree arc of rotation in a clockwise direction as seen in FIG. 6. As will be apparent the repeated vertical reciprocal actuation of plunger 94 will serve to intermittently index said rotary cupped valve member 86 through successive 60 degree displacements to its said successive predetermined operative positions respectively.

The ratchet wheel 92 for driving said rotary valve member 86 is adapted to be rotatably indexed not only by a first control means, namely the trigger plunger 94 and pawl 93, but also by a second control means that includes a second pawl 200. FIGS. 1, 6 and 7, that is pivotally mounted on a second plunger 201 by means of a suitable pivot stud 202, FIG. 6. The pawl 200 is yieldably biased in a counter clockwise direction, as seen in FIG. 6, by a suitable spring 203 so that the operative latching nose 204, FIG. 6, of the pawl is continuously urged towards the teeth of said ratchet wheel 92. The axially central portion 201*a* of plunger 201 which carries the pawl 200, pivot stud 202, and spring 203 has a rectangular cross section, and is arranged so that one flat side thereof may vertically slide along the flat inner surface 205, FIG. 7, of the recessed end of the valve block 70. The remaining portions of the plunger 201 are cylindrical; the upper end thereof extending through a a suitable aperture formed in the said upper wall 70*a* of the valve block 70 while the lower end thereof extends downwardly into a bore 206, FIG. 8, formed in said main body portion 23 of the feeder frame. The plunger 201 is adapted to be actuated by means of a fluid motor 207, FIG. 8, that comprises a piston 210 that is fixed to said lower end of the plunger 201 by means of a suitable screw 211; the piston 210 being slidably disposed in a cylinder 212 formed in said main body portion 23. The piston 210 is yieldably biased in an upward direction by means of a spring 213 that is disposed between the lower side of said piston and a pin 214 disposed across the open bottom portion of said cylinder 212. The normal upper or FIG. 6 position for plunger 201 is determined by spring 213 urging the upper shoulders of said rectangularly cross sectioned plunger portion 201*a* into engagement with the lower surface of said valve block wall 70*a*. As will be apparent when pressure fluid is introduced into the upper portion of the cylinder 212 the plunger 201 will move downwardly to a lower position determined by engagement of the lower shoulders of said rectangular plunger portion 201*a* with the adjacent upper surface 23*a*, FIGS. 6 and 8, of said main body portion 23. The extent of this downward movement is just sufficient for pawl 200 to rotatably index said ratchet wheel through one incremental 60 degree step. When pressure fluid is exhausted from cylinder 212 spring 213 will restore the plunger 201 and pawl 200 to their normal upper or FIG. 6 positions where they will be ready to produce another 60 degree rotational indexing step of said ratchet wheel 92, in response to the next operation of the fluid motor 207.

The detailed construction and arrangement of the cooperating valving surfaces of the stationary valve plug 76 and the rotary valve cup member 86 and the associated pressure fluid conducting lines will now be described with particular reference initially to FIGS. 2 and 11–14. The said port 81, FIG. 12, formed in the end face 78 of the stationary valve plug 76 communicates with and services the said stock gripper motor 31 on the feed slide 20 while port 80 communicates with and services the said main fluid motor 32 associated with said feed slide 20. In similar fashion ports 83 and 82 are respectively connected to and service the gripper and main fluid motors associated with the other feed slide 21. Communicating respectively with the ports 80, 81, 82 and 83 formed in the end surface 78 of the valve plug 76 are four fluid conduit lines 80*a*, 81*a*, FIGS. 11 and 15, 82*a*, FIGS. 15–17, and 83*a*, FIGS. 15–18, respectively. These straight fluid conduit lines 80*a*, 81*a*, 82*a* and 83*a* formed in plug 76 are each disposed parallel to the plug axis and extend to varying depths in said plug corresponding respectively to the locations of section lines 15, 16, 17 and 18 shown in each of FIGS. 2, 19 and 21; cross sectional views of plug 76 at said sections 15, 16, 17 and 18 being illustrated in FIGS. 15, 16, 17 and 18 respectively.

Figure 15:
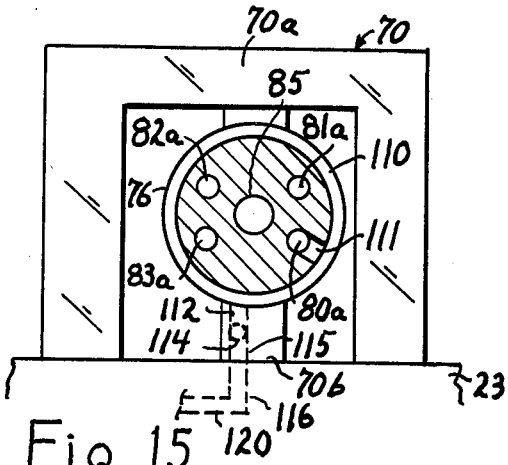
FIG. 15 is a somewhat enlarged end elevational view of the valve block with a portion there of removed so that the valve plug may be shown in cross section as taken in vertical planes indicated by line 15 of FIGS. 2, 19 and 21.
Figure 19:
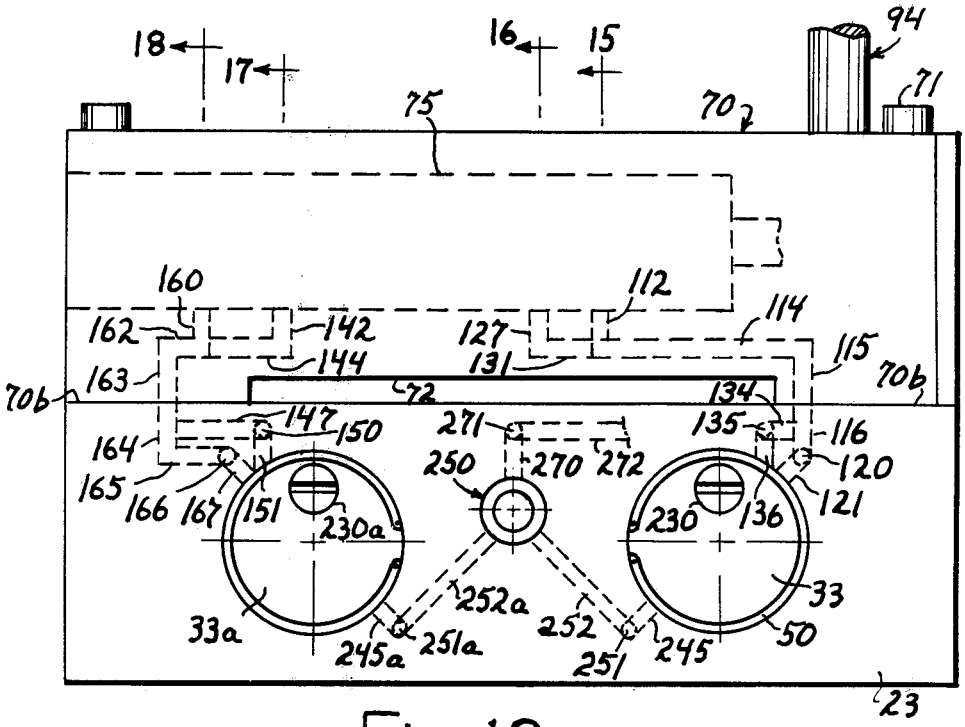
FIG. 19 is an end view taken from the left as seen in FIG. 1 and illustrates the arrangement of fluid conduit lines between the valve means and the head ends of the two main fluid motors.

Fluid conduit line 80*a* which is associated with the main fluid motor 32 effectively extends to and ends just past section 15 indicated in FIG. 2 and, as illustrated in FIG. 15, communicates with an annular groove 110, FIGS. 2 and 15, formed on the outer cylindrical surface of plug 76 through a radial line 111, FIG. 15. The valve body 70 is formed with a vertical fluid conduit line 112, FIGS. 15, 19 and 21, that communicates at its upper end with said groove 110 and at its lower end communicates with a laterally extending horizontal line 114, FIGS. 15, 19 and 21, which in turn communicates with a line 115, FIGS. 15, 19 and 21, that extends downwardly through the adjacent bottom surface 70*b*, FIG. 19, of the valve block 70. In FIG. 15 for ease of illustration only fluid conduit lines in the valve block that communicate with said plug groove 110 are illustrated. When the valve block 70 is secured on the feeder frame as illustrated in FIGS. 1, 2 and 19 etc. the said line 115 communicates with the upper end of a vertical line 116, FIGS. 15, 19 and 20, formed in said main body portion 23 of said frame. Line 116 communicates with a horizontal line 120, FIGS. 8 and 20, also formed in said frame portion 23. Line 120 communicates through an angular line 121, FIGS. 19–21, with said main cylindrical plug groove 53 so as to communicate with and service the said main fluid motor 32 as above described.

Figure 16:
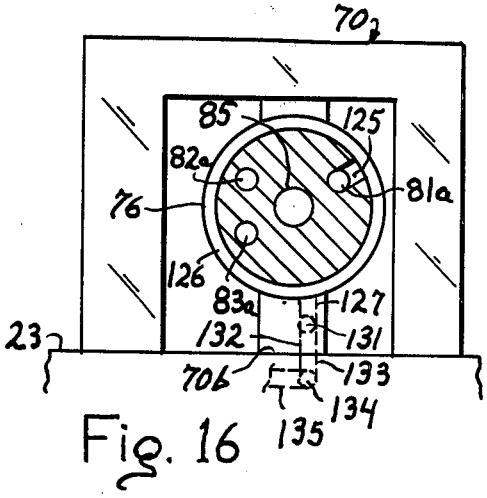
FIGS. 16, 17 and 18 are views each corresponding to FIG. 15 but taken in vertical planes indicated by lines 16, 17 and 18 of FIG. 2 respectively.

The longitudinal fluid conduit line 81*a*, FIG. 16, in the valve plug 76 which is associated with the gripper fluid motor 31 effectively extends to and ends just past the section line 16 of FIG. 2 and, as shown in FIG. 16, communicates through a radial line 125 with a second annular groove 126, FIGS. 2 and 16, formed in the cylindrical outer surface of plug 76. The valve block 70 is formed with a vertical line 127, FIGS. 16 and 19, which communicates with a laterally extending horizontal line 131, FIGS. 16, 19 and 21, which in turn communicates with a line 132, FIGS. 8 and 21, that also extends vertically downward through the said bottom surface 70*b* of the valve block 70 as is best seen in FIGS. 16 and 21. In FIG. 16 only the valve block fluid conduit lines that communicate with said plug groove 126 are shown. The air line 132 communicates with the upper end of a vertical line 133, FIGS. 16 and 20, formed in said frame portion 23. Line 133 communicates with a laterally extending horizontal line 134, FIGS. 6, 8, 16 and 20, which in turn communicates with another horizontal line 135 also formed in said body portion 23. Line 135 communicates through a line 136 with the said main cylinder plug groove 47 as illustrated in FIGS. 8, 19 and 20, so as to communicate with and service said gripper motor 31.

Figure 17:
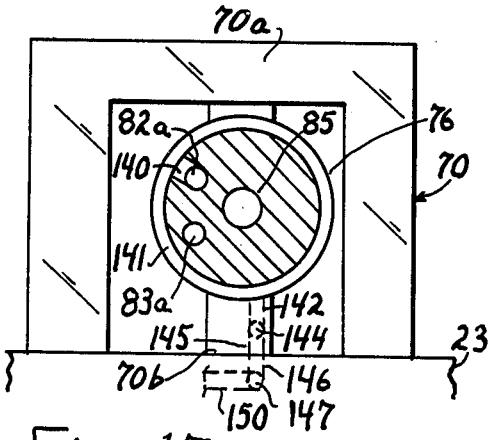
Figure 20:
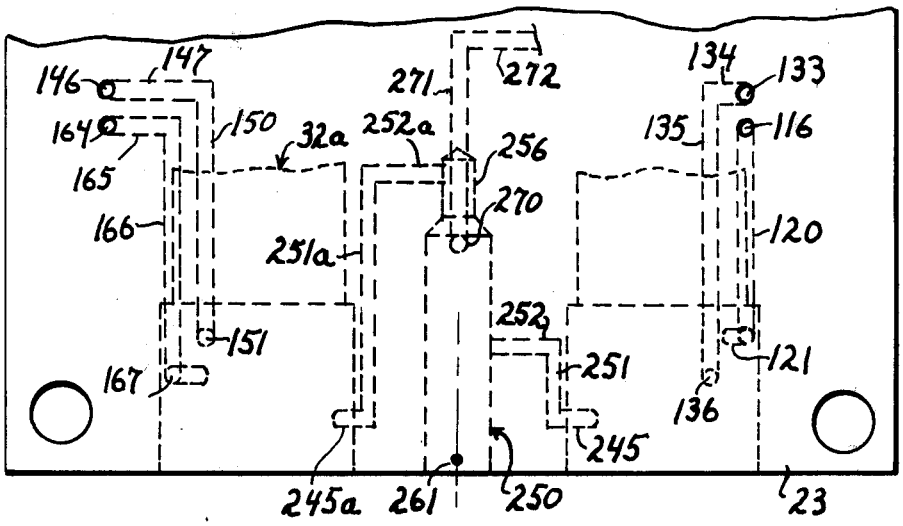
FIG. 20 is a plan view of the head end of the feeder frame (with the valve block 70 removed) and illustrates the arrangement of fluid conduit lines in the main body portion of the feeder frame adjacent the said head ends of the main cylinders.

Similarly the line 82*a*, FIG. 17, in the plug 76, which line is associated with second main fluid motor 32*a*, FIG. 20, extends to a depth corresponding to section line 17 of FIG. 2 and communicates through a radial line 140 with a third annular groove 141, FIG. 2, formed on the outer cylindrical surface of said valve plug 76. The valve block 70 is formed with a vertical fluid conduit line 142 which communicates at its upper end with the said plug groove 141 and which communicates at its lower end with a laterally extending horizontal line 144 which in turn communicates with a line 145 that extends downwardly through the bottom 706, FIG. 19, of the valve block. In FIG. 17 only the valve block fluid conduit lines that communicate with said plug groove 141 are shown. The line 145 communicates with the serially arranged lines 146, 147, 150, 151, FIGS. 17, 19 and 20, formed in said frame portion 23 that service the main fluid motor 32*a* associated with feed slide 21 in an arrangement and manner similar to that just described for the main fluid motor 32.

Figure 18:
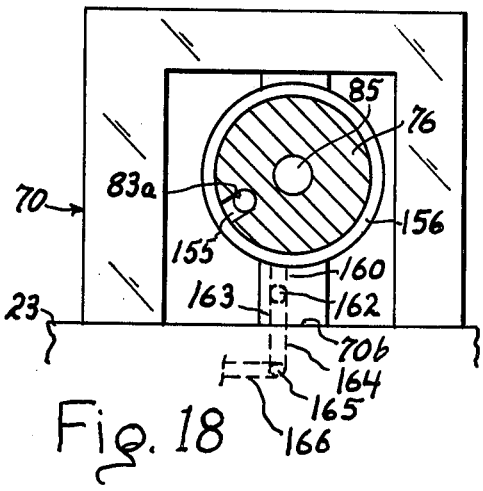

The air line 83*a*, FIG. 18, in plug 76, which is associated with the gripper motor or feed slide 21, effectively extends to a depth corresponding to the section line 18 of FIG. 2 and communicates through a radial line 155 with a fourth annular groove 156 formed on the outer cylindrical surface of the valve plug 76. The valve block 70 is formed with a vertical line 160 the upper end of which communicates with the said plug groove 156 while the lower end of which communicates with a laterally extending horizontal line 162 that in turn communicates with a line 163 that extends vertically downward through the said bottom surface 70*b* of the valve block 70. In FIG. 18 only the valve block fluid conduit lines that communicate with said plug groove 156 are shown. The line 163 communicates with the serially arranged lines 164, 165, 166 and 167, FIGS. 18, 19 and 20, formed in said frame portion 23 that communicate with and service the gripper motor 31*a*, FIG. 22, associated with said second feed slide 21 in an arrangement and manner similar to that just described for the gripper motor 31 associated with the first feed slide 20. The four grooves 110, 126, 141 and 156 formed in valve plug 76 are mutually isolated by O-ring seals such as 168, FIG. 2, carried by said plug 76.

Figure 12:
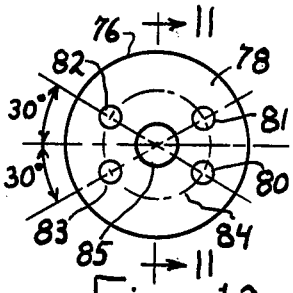
FIG. 12 is an end view of the stationary cylindrical valve plug of the present main fluid valve means.
Figure 13:
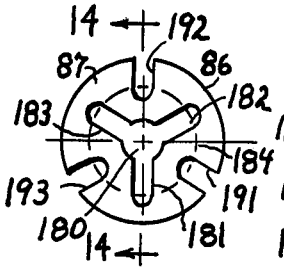
FIG. 13 is an end view of the cupped valving face of the rotary valve member of the present main valve means.

The details of the construction and operation of the rotary valve member 86 will now be described with particular reference to FIGS. 11–14. As will be seen from FIG. 12 the supply and exhaust of fluid pressure to and from the four ports 80, 81, 82 and 83 will control the four fluid motors of the present feeder, i.e. the main motor 32, gripper motor 31 associated with the feed slide 20 and the corresponding main and gripper fluid motors 32*a* and 31*a* associated with the second feed slide 21, respectively. The rotary valve cup member 86 is adapted to control the flow of pressure fluid into and out of said four ports in a predetermined sequence so as to impart alternate operative stock feed strokes to said two feed slides 20 and 21. The said flat end face 87, FIGS. 13 and 14, of the rotary valve cup member 86 is formed at its center with a cylindrical recess 180. Three equally spaced radial recesses or slots 181, 182 and 183 are also formed in said face 87, each communicating at its radially inner end with said recess 180. The radially outer ends of said slots 181, 182 and 183 each have a semi-circular shape as is illustrated in FIG. 8, each such semi-circular profile having a center that is located on a circular line of centers 184, FIG. 13, that has a radius equal to that for said circular line of centers 84 of FIG. 12 for said ports 80–83. The peripheral flanged portion of the rotary valve member 86 is formed with three equally spaced and radially extending slots 191, 192 and 193, FIGS. 13 and 14; the radially inner ends of said slots also having semi-circular shapes as illustrated in FIG. 13 with the center of each such semi-circular profile also being located on said line of centers 184. The arcuate spacing of the inner slots 181–183 with respect to the outer slots 191–193 in said rotary valve member is such that the successive semi-circular profiles having centers on said line of centers 184 are mutually spaced 60 degrees apart.

The rotary valve member 86 is disposed in the inner end of said bore 75, FIG. 2, of the valve block 70; this inner end of said bore serving as a valve chamber **75*a* to which pressure fluid may be continuously supplied by any suitable means. The pressure fluid supply passages to said valve chamber may for example be defined by serially communicating lines 194, 195 and 196, FIGS. 2 and 21 formed in the valve block 70 and through the serially communicating vertical line 197 and two horizontal lines 198 and 199, FIG. 2, formed in the main body portion 23 of the feeder frame. The inner portions of line 199 communicate with the rod ends of both main fluid motors 32 and 32*a*, as may be seen from FIGS. 1 and 2, while the outer end thereof communicates with a threaded inlet aperture 199*a*, FIG. 2, that is adapted to be connected with an external fluid pressure supply line. It will be understood that the horizontal line 198 extends substantially parallel to the feeder axis and communicates line 199 with said line 197. By such an arrangement of fluid conduit lines the valve chamber 75*a*** and the rod ends of the two main cylinders may be continuously supplied with pressure fluid.

Figure 11:
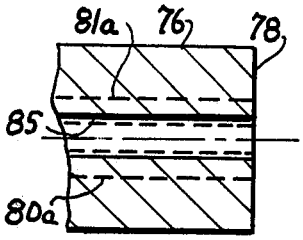
FIG. 11 is an axial sectional view taken along section line 11—11 of FIG. 12.
Figure 14:
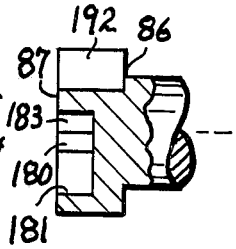
FIG. 14 is an axial sectional view taken along section line 14—14 of FIG. 13.

When the flat planar smooth end face 87, FIGS. 13 and 14, of the rotary valve cup member 86 is axially biased into coaxial rotational sliding engagement with the flat smooth planar surface 78, FIG. 11, of the stationary valve plug 76, each of the ports 80, 81, 82 and 83 will be alternately coupled to the common exhaust line 85 in the plug 76 and to the valve supply chamber **75*a* in response to the successive incremental 60 degree rotational indexing movements of the rotary valve member 86 as produced by the operation of the 60 degree incremental movements of the ratchet wheel 92 described above in connection with FIGS. 6–8. For example when the rotary valve member 86 is rotationally positioned so that the outer flange slot 193 is in registry with the port 80 of the plug 76 pressure fluid from said valve chamber 75*a* may flow through said slot 193 and into port 80 and thus to the head end of the main fluid motor 32. With such registry the inner slot 183 will be in simultaneous registry with the port 81 so that pressure fluid from the gripper fluid motor 31 may exhaust through said port 81 to the said common exhaust line 85 through said slot 183 and the central recess in the face 87 of the rotary valve cup member 86. This combination of supplying pressure fluid to port 80 and exhausting pressure fluid from port 81 will cause the feed slide 20 to partake of a non-feed or index stroke. At the same time the other feed slide 21 will partake of a stock feed stroke because ports 82 and 83 will simultaneously be coupled to exhaust line 85 and pressure fluid supply chamber 75*a* respectively through slots 182 and 191 respectively. By indexing the rotary valve member 86 through a 60 degree arcuate step the above noted supply and exhaust conditions at the respective four ports 80, 81, 82 and 83 will be reversed so that feed slide 20 will now partake of a feed stroke while the feed slide 21 partakes of an index stroke. As will be apparent then the feed slides 20 and 21 may alternately partake of feed strokes in response to the successive operation of said ratchet mechanism 69, FIGS. 1 and 6; actual shifting of the supply and exhaust conditions at said ports 80–83 occurring during the terminal portion of each 60 degree rotary indexing movement of the ratchet wheel 92. As will be apparent any wear of the said polished flat valving surfaces 78 and 87 will be automatically taken up by the rotary valve member 86 being axially biased against the end surface 78 of said plug 76 by the action of both said spring 90, FIG. 7, and the fluid pressure in said supply chamber 75*a*. The valve ports 80 and 82 may be made slightly smaller in diameter than that for ports 81 and 83** respectively so as to produce a slight delay in the initiation of the operation of the main fluid motors in relation to the respective initiation of operation of the gripper fluid motors respectively. This will facilitate the proper timing of operation of each gripper fluid motor with respect to its associated main fluid motor.

Figure 3:
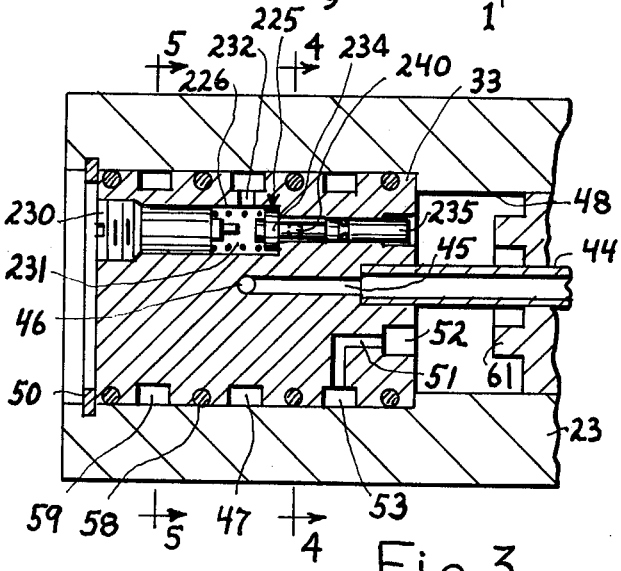
FIG. 3 is an axial sectional view taken along the same section line as that for FIG. 1 and shows the head end of one of the two main fluid motors.

As was described above the ratchet mechanism 69 for incrementally rotating the valve member 86 may be actuated by operation of either the trigger plunger 94, FIG. 1, and its associated pawl 93 in response to the movement of the press ram, or the plunger 201 and its associated pawl 200 by the fluid motor 207, FIG. 6–8. The fluid motor 207 is adapted to be operated in response to the completion of a feed stroke by either or both of the feed slides 20, 21 as will now be described. Referring primarily to FIGS. 3, 9, 10, 19 and 20, a control valve 225, FIG. 3, is provided in the plug 33 at the head end of the main cylinder 48, said valve comprising a first bore 226 and a coextensive smaller diameter coaxial bore 227, FIG. 10, formed longitudinally through said plug 33. The left end of bore 226, as seen in FIG. 3, is closed by a threaded plug member 230. The inner end of bore 226 defines a valve chamber 231 which communicates with the said peripheral plug groove 47 through a passage 232. The right hand end of the valve chamber 231 is adapted to be closed by a movable valve member 233, FIG. 10, having formed at its inner end a disc portion 234 to which is integrally connected a coaxial stem 235 which extends through said bore 227 and which has an inner portion 236 of reduced diameter. When the right hand side of the valve disc 234 is seated on the annular shoulder at the inner end of bore 226, as is shown in FIG. 3, the right hand end, as seen in FIGS. 3 and 10, of the valve stem 235 will extend into the said annular plug groove 52, FIG. 3, formed on the inner face of plug 33. A suitable compression spring 237, FIG. 10, may be provided in the valve chamber 231 so as to lightly bias the valve member 233 to a normal right hand position shown in FIG. 3. A stop projection 238 is formed on the left end, as seen in FIG. 10, of valve member 233 so as to limit the extent of possible leftward movement, as viewed in FIG. 10, of said member 233. The valve disc 234, which has an effective diameter between that for bores 226 and 227, when in this normal position prevents flow of pressure fluid from valve chamber 231 into bore 227. The valve member 233 may be axially displaced from its normal closed FIG. 3 position to its open position shown in FIG. 10; this displacement being produced by engagement of said annular projection 61 on the face of the main piston of said fluid motor 32 with the end of valve stem 235 and displacement of the latter to the left, as shown in FIG. 10, in response to the terminal portion of said feed stroke of feed slide 20. In this open or FIG. 10 position of the valve member 233 pressure fluid may flow from valve chamber 231 into bore 227 and through fluid conduit lines next to be described so as to energize the said fluid motor 207 which actuates the said ratchet mechanism 69.

Figure 4:
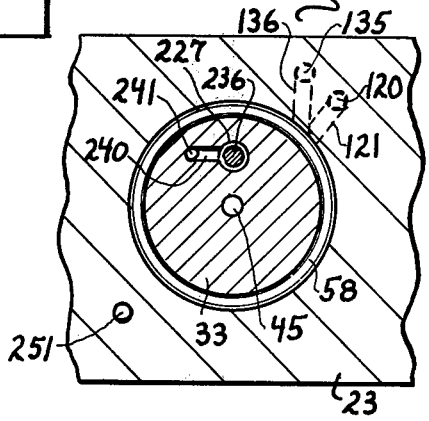
FIG. 4 is a sectional view taken along section line 4—4 of FIG. 3.
Figure 5:
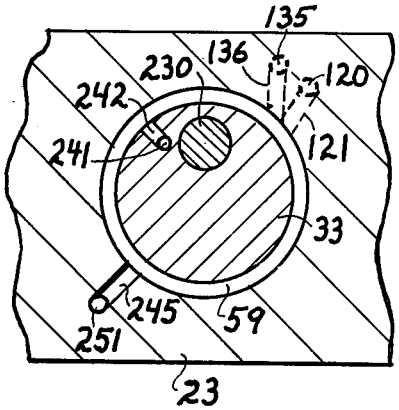
FIG. 5 is a sectional view taken along section line 5—5 of FIG. 3.

Referring primarily to FIGS. 3, 4 and 5 the plug 33 is formed with a horizontal passage 240. FIGS. 3, 4 and 10, that communicates at its inner end with said bore 227 and at its outer end with a longitudinal passage 241, FIGS. 4 and 5, that in turn communicates through a radial line 242, FIG. 5, with the said third peripheral groove 59, FIGS. 3 and 5, formed on the cylindrical outer surface of plug 33. The passage 241 extends substantially parallel to the axis of plug 33 and between the cross sectional planes 4—4 and 5—5 indicated in FIG. 3. As indicated in FIG. 5 the said plug groove 59 communicates with a passage 245 formed in the said main body portion 23 of the feeder frame. The plug **33*a*, FIGS. 2, 19 and 22, associated with the second main fluid motor 32*a* and the associated valve 225*a*, FIGS. 2 and 22, for controlling the fluid motor 207, is constructed and operates in a manner corresponding to that just described for plug 33 and its control valve 225. It will be noted that elements referred to in connection with said second main fluid motor 32*a* have the same reference numerals as those used for the corresponding parts of the main motor 32 respectively, but have subscripts "a" added thereto. The control valves 225 and 225*a* are each adapted to control the operation of said fluid motor 207 through a conventonal type shuttle valve 250, as will be now explained in connection with FIGS. 6, 9, 19 and 20. Referring to FIGS. 19 and 20 the angular line 245 communicates with a horizontal line 251 which in turn communicates with an angular passage 252, formed in said main body portion 23. Corresponding lines 245*a*, 251*a* and 252*a* are provided in connection with the plug 33*a*; these two sets of lines respectively communicating with opposite operative ends of said shuttle valve 250. The shuttle valve includes a first bore 255, FIG. 9, and a second coextensive coaxial but smaller diameter bore 256 formed in said main body portion 23. A valve plug 257 having a suitable O-ring seal 260 thereon is adapted to close the left end of said bore 255 as seen in FIG. 9; plug 257 being retained in the position shown by any suitable means such as a pin 261. The inner facing annular ends of the bore 255 and the plug 257 are closely mutually axially spaced and are bevelled at substantially 45 degrees with respect to the axis of said bore 255 and define therebetween a valve chamber 262 in which is axially movably disposed a shuttle valve member 263. Extending axially away from each 45 degree bevelled face of the central portion of the valve member 263 are cylindrical extensions having reduced diameters that extend into and slidably engage said bore 256 and a bore 264 respectively; bore 264 being formed in the inner end of said plug 257. The ends of said reduced extensions are each slotted as indicated at 265, FIG. 9. The left hand end of bore 264 communicates through a radial passage 266 with an annular groove 267 formed on the periphery of said plug 257. The groove 267 communicates with the inner end of said angular line 252 while the bore 256 communicates with the inner end of said angular line 252*a*; line 252 and 252*a* being shown in dotted lines in FIG. 9 for convenience of illustration. The valve chamber 262, FIG. 9, communicates with a shuttle valve output line 270 which in turn communicates with a horizontal longitudinal line 271. The right hand end of line 271, as seen in FIG. 9, communicates with a laterally extending line 272, FIGS. 9, 19, 20 and 6, which communicates with a vertical line 273 that in turn communicates with the upper end of the cylinder 212 of the fluid motor 207 as may be seen from FIGS. 1 and 6**.

Referring again to FIG. 9 the axially movable shuttle valve member 263 is adapted to be disposed in a first or right hand position as shown in FIG. 9 wherein pressure fluid may flow to and from the fluid motor 207 through the valve 225 through lines 245, 251, 252, 253, groove 267, line 266, bore 264, slot 265, chamber 262 and the shuttle output lines 270, 271, etc. while the line **252*a* is isolated from said output line 270 etc. as is best seen from FIG. 9. The shuttle valve member is adapted, after fluid motor 207 is exhausted or deenergized, to be shifted to the left, as seen in FIG. 9, by the introduction of pressure fluid into line 252*a*, to a second position wherein pressure fluid may flow to and from the fluid motor 207 through valve 225*a*, lines 245*a*, 252*a*, 253*a*, the bore 256, slot 265, chamber 262, the output line 270 etc. while the line 252 is isolated from said output line 270. The construction and operation of the shuttle valve 250** is effectively identical to that used in the shuttle valve model MJSV-1 that is commercially offered by the Clippard Co. of Cincinnati, Ohio; and if further details thereof are desired reference may be made to such model.

Referring back to FIG. 3 it will be noted that when feed slide 20 partakes of a feed stroke pressure fluid will be present in the groove 47 of the plug 33 so that gripper motor 31 is thereby operated. Under these conditions pressure fluid will also be present in said valve chamber 231 of control valve 225 through passage 232 communicating with groove 47 so that at the end of said feed stroke of feed slide 20 the valve member 233 of valve 225 when displaced to the left as shown in FIG. 10 will permit fluid to flow from chamber 231 through lines 240, etc. through the shuttle valve as above described so that fluid motor 207 may be thereby operated. Control valve **225*a* operates in a similar manner. The ratchet actuating fluid motor 207 may thus be operated under the control of either the valve 225 that is operated in response to the completion of a feed stroke of feed slide 20 or under the control of the corresponding valve 225*a* that is similarly operated in response to the completion of a feed stroke of said feed slide 21**.

The operation of the present feeder will now be described with reference to the schematic view in FIG. 22. When the ram of the punch press with which the present feeder is to be used moves downwardly and then upwardly through a refractive stroke the trigger plunger 94 will follow the lower portion of this ram movement in a manner corresponding to that in said U.S. Patents. During the upward retractive ram movement, the corresponding upward plunger motion caused by the action of the plunger spring 105 will through pawl 93 produce a first 60 degree rotary indexing step of both the ratchet wheel 92 and rotary valve means 68. Let it be assumed for the purpose of this discussion that this 60 degree shift in valve position will cause feed slide 20 to initiate a feed stroke in feed direction 300, FIG. 22, while feed slide 21 initiates an index stroke in an index direction 301. As feed slide 20 completes its said feed stroke the control valve 225 will be operated as above described so as to supply pressure fluid to the fluid motor 207. The resultant operation of the ratchet mechanism by reason of the actuation of fluid motor 207 will advance the rotary valve member 86 through a second 60 degree step whereupon the main valve means 76, 86 will cause feed slide 20 to commence an index stroke and feed slide 21 to commence a feed stroke. When this occurs gripper motor 31 and thus fluid motor 207 will be exhausted through the said plug groove 47 (to which both of said motors 31 and 207 are coupled as above described) and through the main valve means 76, 86 in the manner previously described in connection with the operation of the main valving arrangement of FIGS. 11–18. Thus the plunger 201, together with pawl 200, will be restored by spring 213 to its upper position shown in FIGS. 1, 6 and 22 preparatory to producing the next 60 degree rotary indexing movement of said ratchet wheel 92 by the fluid motor 207. At the end of the feed stroke of feed slide 21 the control valve **225*a* associated therewith will be operated in the same manner as above described for control valve 225 whereby the fluid motor 207 is again actuated so as to cause the ratchet mechanism 69 to advance the rotary valve member 86 to a third 60 degree step so as to thereby cause feed slide 21 to partake of an index stroke while feed slide 20 partakes of another feed stroke. This automatic repeat feed action of the feed slides 20, 21** will continue until stopped after a desired number of feed strokes have been produced.

The means for interrupting the repeat feed action of slides 20, 21 may for example comprise simply smoothly grinding off, or otherwise removing, one ratchet tooth as indicated by the dotted lines **92*a* in FIG. 26. This removal of one ratchet tooth will result in there being no ratchet indexing movement by pawl 200 when the position of the removed tooth reaches the position indicated in FIG. 26. Under these conditions the downward movement of plunger 201 in response to actuation of fluid motor 207 will produce no indexing movement of the rachet mechanism 69 and thus the said repeat feed action of the slides 20, 21 will be stopped and the fluid motor 207 will here remain in an actuated condition thereby retaining plunger 201 in its lower position. The next series of repeat feed strokes is initiated by the actuation of plunger 94 in response to the next punch press cycle, i.e. in response to the next upward retractive movement of the press ram. This next upward movement of plunger 94 will produce a 60 degree index of the ratchet mechanism 69 and thus will cause the gripper motor last energized and the fluid motor 207 to be exhausted and will further cause the feed slide last moved through an index stroke to partake of the first feed stroke in this next series of feed strokes. In response to the initiation of the last mentioned index and first feed strokes, (a) the pawl 200 will be moved to an upper FIG. 1 position by spring 213 so as to be capable of producing another 60 degree ratchet index movement in response to the completion of said first feed stroke in the manner above described. Once this next series of repeat feed actions is thus started it will continue until the missing ratchet tooth position 92*a* rotates through one revolution and again reaches the FIG. 26 position whereupon this repeat action is again interrupted until the third feed stroke series is initiated in response to the next cyclic operation of the press ram and plunger 94 in the manner above described. In this particular case, there being six tooth positions for ratchet 92, there will be a total of six successive automatic stock feed strokes produced by feed slides 20, 21 in response to each actuation of the plunger 94**. Thus a relatively short feeder of the present type can feed a long length of stock in response to each cycle of a continuously running press.

An alternate means for controlling the number of feed strokes produced for each cyclic operation of said plunger 94 is illustrated in FIGS. 27 and 28. Here there are no teeth removed from the ratchet wheel 92 and a control disc 310 having a central aperture is removably fixed on the outer face of ratchet wheel 92 by any suitable means such as pins 311. The control disc shown is formed with two diametrically opposed camming lobes 312 and 313 each of which is adapted to cammingly engage a laterally extending pin 314 secured to the side of the said nose of the pawl 200. As will be apparent when the ratchet wheel 92 is indexed to a position such as illustrated in FIG. 27 the pawl 200 will be prevented from engaging the adjacent ratchet tooth and hence when fluid motor 207 is next energized the pawl 200 will move downwardly but will produce no 60 degree indexing step of the ratchet mechanism. Using a two lobe cam 310 and a six toothed ratched wheel as shown in the particular arrangement of FIGS. 27 and 28 each cyclic actuation of the said trigger plunger 94 will thus generate a series of three repeat feed strokes by the feed slides 20 and 21. As will be apparent the number of teeth provided on ratchet wheel 92 as well as the number of equally angularly spaced lobes provided on the control disc 310 may be varied in accordance with the number of feed strokes desired for each series of repeat actions of the feed slides. For example, if a series of only two stock feed strokes in the repeat action is desired for each cyclic actuation of trigger plunger 94, the ratchet wheel could have eight teeth and the control cam 310 could be provided with four cam lobes that were effectively spaced 90 degrees apart.

Another control arrangement for obtaining just two feed strokes for each actuation of the trigger plunger 94 is illustrated in FIG. 23. Here valve **225*a* is eliminated and only one control valve (225) is used and the output line 320 thereof is coupled directly to the fluid motor 207. Thus the feed slide 20 may complete a feed stroke and then an index stroke (while slide 21 is simultaneously completing an index and then a feed stroke) but in that there is no control valve 225*a* present to be actuated in response to the completion of the feed stroke of slide 21**. This feed series stops after said two feed strokes.

If only one feed stroke is desired for each cyclic operation of the plunger 94, a pin 325, FIG. 6, may be inserted through a suitable diametral hole formed in the upper end of said plunger 201 as indicated in FIG. 6 whereby any downward movement of plunger 201 is prevented even when pressure fluid is directed to the fluid motor 207.

The present feeder may be provided with an alternately constructed valve plug 76 so that feed slides 20,

21 move together through a feed stroke. Here the line 82*a* is formed so as to communicate only with the plug groove 156 while the line 83*a* is formed so as to communicate only with the plug groove 141; the plug 76 otherwise remaining the same. Here the slides 20, 21 will be operated in phase with one another and both will be normally disposed in their indexed positions and will, in response to the actuation of plunger 94, move together through a feed stroke and after completion of such feed stroke will automatically return together to their said indexed positions and remain there until the next cyclic actuation of said plunger 94. This control arrangement may be used where high stock gripping and feeding (pulling) forces are desired as when heavy stock is to be fed and processed.

In FIG. 25 there is shown a typical series of interconnected fluid conducting lines 400, 401, 402, and 403 formed in an exemplary solid body 404 in order to permit fluid flow 405 into line 400 and fluid flow 406 out of line 403. The actual forming of these lines may be brought about in the manner illustrated in FIG. 24, wherein the hole 400 is first drilled, then hole 401 is drilled from the left, as seen in FIG. 24, and plugged at its outer end as indicated at 401*a*. Thereafter hole 402 is drilled from the bottom and plugged as indicated at 402*a*, after which the hole 403 is drilled from the right as seen in FIG. 24. For ease of illustration and description the various air lines and passages presented in connection with the present feeder have been shown in a manner similar to that illustrated in FIG. 25 but it will be understood that such lines may be formed by the drill and plug technique illustrated in FIG. 24.

If desired one or both of the feed slides 20, 21 may be provided with stock gripper motor exhausting or release valve means of the type described in my said prior U.S. Pat. No. 4,051,987 so that the stock being fed may be released after each feed stroke thereof.

As may be seen from the above disclosure the present feeder is very flexible and efficient in its construction and operation.

I claim:

1. A pneumatically operated feeder that is adapted to intermittently advance stock into the work station of a punch press or the like having a working ram; said feeder comprising a frame;

a first and second feed slides reciprocally mounted on said frame for movement in feed and index directions;

stock gripping means carried by each of said feed slides and adapted to be moved between stock gripping and stock release positions;

first fluid motor means for reciprocally actuating said feed slides;

a second fluid motor means for actuating said stock gripping means between said stock gripping and stock release positions;

valve means shiftable to a plurality of operative conditions for controlling the operation of said first and second fluid motor means whereby each of said feed slides may be moved through alternate feed and index strokes;

rotary drive means intermittently indexible to successive predetermined rotational positions and operative thereby to shift said valve means to its said successive operative conditions; and control means for said rotary valve drive means adapted to be operated in timed relation to the operation of said press and to generate at least two serial rotational indexing movements of said rotary drive means for each cycle of operation of said press.

2. Apparatus as defined by claim 1 wherein said control means includes a means responsive to the terminal portion of a feed stroke of said first feed slide for causing said rotary drive means to be rotationally indexed so that said valve means thereby produces a feed stroke of said second feed slide.

3. Apparatus as defined by claim 1 wherein said control means includes a trigger means that is adapted to be operated in response to each cycle of operation of a continuously running press.

4. A pneumatic feeder for intermittently advancing stock into the work station of a continuously running punch press or the like having a reciprocating working ram; comprising a frame;

a first and second feed slides reciprocally mounted on said frame for movement in feed and index directions;

stock gripping means carried by each of said feed slides and adapted to be moved between stock gripping and stock release positions;

first fluid motor means for reciprocally actuating said feed slides;

a second fluid motor means for actuating said stock gripping means between said stock gripping and stock release positions;

valve means for controlling the operation of said first and second fluid motor means whereby each of said feed slides may be moved through alternately feed and index strokes; and a control system for said valve means, said control system being adapted to be responsive to each cycle of operation of said continuously running press to cause said first feed slide to partake of a feed stroke, then cause said second feed slide to partake of a feed stroke, and then to cause said first feed slide to partake of another feed stroke whereby at least three stock feed strokes may be generated by said two feed slides in response to each cycle of operation of said continuously running press.

5. Apparatus as defined by claim 4 wherein said control means includes a means adapted to be operated in response to the terminal portion of a feed stroke of one of said feed slides.

6. Apparatus as defined by claim 5 wherein said control means includes a means adapted to be operated in response to the terminal portion of a feed stroke of the other of said feed slides.

7. A pneumatically operated feeder adapted to intermittently advance stock into the work station of a punch press having a reciprocating working ram; comprising a frame;

feed slide means mounted on said frame for reciprocating movement in feed and index directions;

stock gripping means carried by said feed slide means;

fluid motor means for actuating said feed slide means and said stock gripping means whereby said feed slide means may be alternately moved through feed and index strokes;

valve means for controlling the operation of said fluid motor means, said valve means having a plurality of successive operative conditions for controlling the feed and indexing movements of said feed slide means;

a rotary drive means for actuating said valve means, said drive means being intermittently movable to a plurality of predetermined successive rotational positions so as to shift said valve means to its said plurality of successive operative conditions respectively;

a first control means for causing said rotary drive means to be incrementally rotated to one of its said predetermined rotational positions so as to shift said valve means to one of its said operative conditions; and a second control means for causing said rotary drive means to be incrementally rotated to at least one other of its said predetermined positions so as to shift said valve means to at least another one of its operative conditions, whereby said drive means may be sequentially rotated to a plurality of its said rotational positions by the combined operation of said two control means for alternately actuating said feed slide means through feed and index strokes.

8. Apparatus as defined by claim 7 wherein said first control means includes a means that is adapted to be operated in response to the upward retracting movement of the press ram.

9. Apparatus as defined by claim 7 wherein said first control means includes a trigger means that is adapted to be operated in response to each cycle of operation of a continuously running punch press.

10. Apparatus as defined by claim 7 or 8 wherein said second control means includes a power means that is adapted to be operated in response to the terminal portion of a feed stroke of said feed slide means.

11. Apparatus as defined by claim 7 wherein said second control means includes an additional fluid motor means and an associated valve that is adapted to control the operation of said additional fluid motor means.

12. Apparatus as defined by claim 7 wherein said second control means includes means for causing said rotary drive means to be incrementally rotated to a plurality of its said successive positions each time said first control means is operated.

13. Apparatus as defined by claim 7 wherein said second control means includes an additional fluid motor means and a plurality of separate associated valves that are each adapted to control said additional fluid motor means.

14. Apparatus as defined by claim 7 wherein said rotary drive means includes a ratchet wheel and said first and second control means include two separate means for controlling the rotation of said ratchet wheel.

15. Apparatus as defined by claim 7 wherein said valve means includes a rotatable valving member.

16. Apparatus as defined by claim 11 wherein said rotary drive means includes a ratchet mechanism, and wherein said associated valve is adapted to be operated in response to the completion of an operative stroke of said feed slide means.

17. A pneumatically operated feeder that is adapted to intermittently advance stock into the work station of a punch press or the like having a reciprocating working ram; said feeder including a frame;

first and second feed slides carried by said frame for reciprocating movement in feed and index directions;

stock gripping carried by each of said feed slides and adapted to be moved between stock gripping and stock release positions;

a first fluid motor means for actuating said feed slides in alternate feed and index directions;

a second fluid motor means for actuating said stock gripping means between said stock gripping and stock release positions;

main valve means shiftable to a plurality of operative conditions for controlling the operation of said first and second fluid motor means so that said first and second feed slides may alternately execute stock feed strokes;

a first control means adapted to cause said valve means to be shifted so that said first feed slide partakes of a feed stroke;

a second control means operative in response to the terminal portion of said feed stroke of said first feed slide for causing said valve means to be shifted so that said second feed slide partakes of a feed stroke; and a third control means operative in response to the terminal portion of said feed stroke of said second feed slide for causing said valve means to be shifted so that said first feed slide again paratkes of a feed stroke, whereby at least three feed strokes are generated by said feed slides in response to each operation of said first control means.

18. Apparatus as defined by claim 17 wherein said valving means includes a rotatable valving member.

19. In a pneumatically operated feeder that is adapted to intermittently advance stock into the work station of a punch press or the like having a reciprocating working ram; said feeder including a frame;

first and second feed slides carried by said frame for reciprocating movement in feed and index directions;

stock gripping carried by each of said feed slides and adapted to be moved between stock gripping and stock release positions;

a first fluid motor means for actuating said feed slides in alternate feed and index directions;

a second fluid motor means for actuating said stock gripping means between said stock gripping and stock release positions;

valve means shiftable to a plurality of operative conditions for controlling the operation of said first and second fluid motor means so that said first and second feed slides may alternately execute stock feed strokes; and ratchet means indexible to a plurality of predetermined successive rotatable positions and being operative thereby to sequentially shift said valve means to its said operative conditions respectively: the improvement comprising a control system having a plurality of means adapted to actuate for said ratchet means whereby said valve means may be effectively controlled from a plurality of different control points by said plurality of actuating means respectively: said control system including a first means for rotatably actuating said ratchet means for causing said valve means to be shifted to a first one of its said operative conditions so that said first feed slide may execute a feed stroke; and a second means for rotatably actuating said ratchet means for causing said valve means to be shifted to another one of its said operative positions so that said second feed slide may execute a feed stroke; whereby said first and second feed slides may partake of a plurality of feed strokes for each operation of said first actuating means.

20. Apparatus as defined by claim 19: additionally comprising a first control means for said second actuating means and adapted to be operated in response to the terminal portion of a feed stroke of said first feed slide.

21. Apparatus as defined by claim 20 additionally comprising a second control means for said second actuating means and adapted to be operated in response to a terminal portion of the feed stroke of said second feed slide whereby at least three stock feed strokes by said feed slides are generated for each operation of said first actuating means for said ratchet means.

22. Apparatus as defined by claim 19 wherein said first actuating means for said ratchet means includes a trigger means that is adapted to be operated in response to each cycle of operation of a continuously running punch press.

23. Apparatus as defined by claim 19 or 22 wherein said second actuating means for said ratchet means includes two separate valve means that are adapted to be operated in response to the terminal portions of the feed strokes of said first and second feed slides respectively, and a third fluid motor means that is adapted to be controlled by each of said two separate valve means.

24. Apparatus as defined by claim 19 wherein said first actuating means is adapted to be operated in response to the retractive upward movement of said press ram so as to cause said ratchet means to shift said valve means to its next operative condition.

25. Apparatus as defined by claim 19 wherein said second actuating means for said ratchet means includes an additional valve means, and a third fluid motor means that is adapted to be controlled by said additional valve means.

26. Apparatus as defined by claim 19 wherein said valve means includes a rotatable valving member.

27. Apparatus as defined by claim 1, 7 or 17 wherein said control means includes means for determining the number of feed strokes to be executed in response to each initiation of operation of said feeder.

* * * * *